US005667211A

United States Patent [19]

Reist

[11] Patent Number: 5,667,211

[45] Date of Patent: Sep. 16, 1997

[54] APPARATUS FOR THE ADHESIVE BINDING OF PRINTED PRODUCTS

[75] Inventor: Walter Reist, Hinwil, Switzerland

[73] Assignee: Ferag AG, Switzerland

[21] Appl. No.: 409,793

[22] Filed: Mar. 23, 1995

[30] Foreign Application Priority Data

Mar. 25, 1994 [CH] Switzerland ..... 00907/94

[51] Int. Cl.[6] ..... B65H 39/00; B42C 11/00

[52] U.S. Cl. ..... 270/52.16; 270/52.18; 270/58.11; 270/58.29; 412/4; 412/20; 412/37; 198/470.1

[58] Field of Search ..... 270/52.16, 52.18, 270/52.2, 58.08, 58.2, 58.11, 58.16, 58.29, 52.22; 412/4, 8, 10, 16, 19, 22, 20, 32, 36, 37; 198/483.1, 470.1, 803.9; 271/903, 315, 187

[56] References Cited

U.S. PATENT DOCUMENTS

| | | | |
|---|---|---|---|
| 1,248,252 | 11/1917 | Bredenberg | 412/19 |
| 1,282,834 | 10/1918 | Hopping | 412/19 |
| 1,760,030 | 5/1930 | Alger | 412/22 X |
| 1,951,300 | 3/1934 | Zimmer | 270/52.2 |
| 2,189,929 | 2/1940 | Schramm | 412/16 X |
| 2,766,870 | 10/1956 | Baker et al. | 270/58.08 X |
| 2,878,496 | 3/1959 | Terzuoli et al. | 412/22 X |
| 3,093,396 | 6/1963 | Segreto | 412/16 |
| 3,179,967 | 4/1965 | Yohn et al. | 412/37 X |
| 3,420,516 | 1/1969 | Guggisberg | 270/52.2 |
| 3,711,083 | 1/1973 | Cantrell, Sr. | 270/52.2 |
| 4,124,203 | 11/1978 | Muller | 270/52.2 |
| 4,408,754 | 10/1983 | Meier . | |
| 4,408,755 | 10/1983 | Meier . | |
| 4,500,241 | 2/1985 | Peters et al. | 412/37 |
| 4,706,951 | 11/1987 | Leu | 270/52.22 |
| 4,723,770 | 2/1988 | Seidel et al. | 270/52.2 |
| 4,743,005 | 5/1988 | Reist | 270/52.22 |
| 4,981,291 | 1/1991 | Honegger et al. | 270/52.3 |
| 5,050,851 | 9/1991 | Eugster | 270/52.22 |
| 5,052,665 | 10/1991 | Sakuragi . | |
| 5,114,292 | 5/1992 | Geiser | 412/37 X |
| 5,137,409 | 8/1992 | Honegger | 270/52.18 X |
| 5,172,897 | 12/1992 | Hansch et al. | 270/52.18 |

FOREIGN PATENT DOCUMENTS

| | | | |
|---|---|---|---|
| 0569887 | 11/1983 | European Pat. Off. . | |
| 0566531 | 10/1993 | European Pat. Off. . | |
| 4008044 | 9/1991 | Germany | 412/37 |
| 21144510 | 8/1983 | United Kingdom . | |

*Primary Examiner*—Hoang Nguyen
*Attorney, Agent, or Firm*—Brinks Hofer Gilson & Lione

[57] ABSTRACT

An apparatus for the adhesive binding includes a plurality of receiving parts which are arranged one behind the other in a circulation direction. A printed product is introduced at a feed location in each receiving part. The receiving parts are driven continuously in the circulation direction, and the printed products are machined upon being transported past a plurality of machining stations. The machining stations necessary for the adhesive binding are arranged one behind the other. The adhesively bound finished products are removed, in a discharge region, from the receiving parts in order to be further transported.

39 Claims, 5 Drawing Sheets

APPARATUS FOR THE ADHESIVE BINDING OF PRINTED PRODUCTS

BACKGROUND OF THE INVENTION

The present invention relates to an apparatus for the adhesive binding of printed products, wherein the apparatus receives the printed products on a plurality of circulating rests which move the printed products through a plurality of machining stations.

An apparatus of this type is disclosed, for example, in U.S. Pat. No. 4,500,241 which corresponds to GB-A-2 114 510. The apparatus disclosed in this reference includes an odd number of receiving parts which are arranged around a common horizontal rotational axis and are open towards the outside in the radial direction. The wheel-like conveying apparatus is further rotated in steps, by in each case two receiving parts, with the result that a paper stack can be pushed into every second receiving part at a feed location. The paper stack is placed on a rest element and is aligned in an aligning station, provided downstream of the feed location. After the alignment, the paper stack is fixedly clamped between the rest element and a controllable clamping member. The feed location is arranged approximately at the level of the rotational axis. A discharge location is located opposite the feed location and offset with respect to the feed location by an odd number of receiving parts. At this discharge location, after every second receiving part has run past, the paper stack, which has been adhesively bound to form a block, is discharged. As seen in the direction of rotation, arranged one after the other between the discharge location and the feed location at intervals of an even number of receiving parts are an adhesive-applying station, a gauze-feeding station and a gauze-bending and pressing-on station. This produces adhesive binding on the paper stack which is fixedly clamped in every second receiving part and transported past the discharge location. The paper stacks thus remain in the receiving parts during approximately one and a half rotations of the conveying apparatus. The machining on the radially outer edge occurs only when the stack being machined is at a standstill. This results in uneven running of the apparatus and thus restricts the machining capacity.

Therefore, it is an object of the present invention to provide an apparatus having increased machining capacity and which will run smoothly.

SUMMARY OF THE INVENTION

These and other objects are achieved by an apparatus wherein a printed product is introduced into passing receiving parts at a feed location. The receiving parts are driven continuously. The printed products are machined as they are transported past machining stations. The machining stations include at least an adhesive applying station. Machining tools from the machining stations run along with the printed products as they move continuously. Despite the continuous running of the receiving parts, this arrangement accommodates operating steps which require a relatively long period of time.

This arrangement results in optimum utilization of the apparatus. Smooth running is achieved by the continuous drive of the receiving parts.

BRIEF DESCRIPTION OF THE DRAWINGS

The present invention is described below in more detail in the exemplary embodiments represented in the drawings, which represent the embodiments purely schematically.

FIG. 1 shows, in elevation, the apparatus shown in FIG. 10.

DETAILED DESCRIPTION OF THE PRESENTLY PREFERRED EMBODIMENTS

Figure 1:
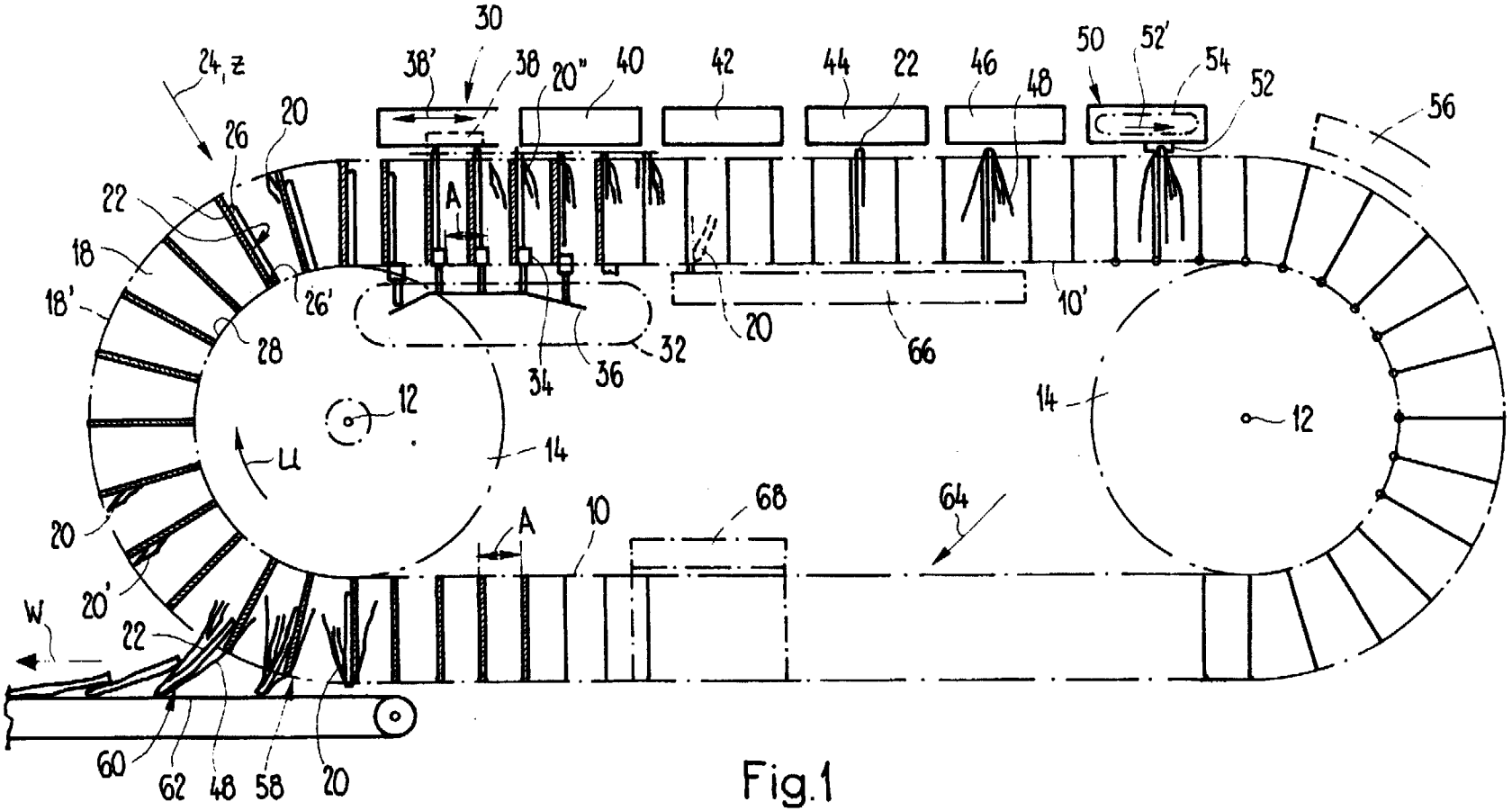
FIG. 1 shows in elevation and in a simplified form, a first embodiment of an apparatus for the adhesive binding of printed products, having receiving parts which are arranged one behind the other on a circulating drawing member, and having machining stations which are arranged one behind the other along the circulating pa of said receiving parts.

FIG. 1 illustrates a first preferred embodiment of the invention for the adhesive binding of printed products. The apparatus shown in FIG. 1 includes an endless drawing member 10, for example a chain. The endless drawing member 10 is driven continuously in the direction of circulation U and is guided around deflection wheels 14 which are spaced apart from one another in the horizontal direction and rotate around parallel horizontal spindles 12. Arranged one behind the other at a distance A on the drawing member 10 are sheet-like rest elements 16. The rest elements 16 extend at right angles with respect to the direction of circulation U. Each rest element 16 the trailing wall, as seen in the direction of circulation U, of a receiving part 18. The receiving part 18 is open radially outwards with respect to its circulating path 18' and the horizontal spindles 12. Each receiving part 18 is assigned a controllable clamping member 20 which, together with the rest element 16, forms a clamping device for fixedly clamping the multiple-part printed products 22 to be machined.

Each receiving part 18 runs past a feed location 24 (specified by an arrow). At this feed location 24, a printed product 22 is introduced, by its trailing edge 26 (as seen in the feed direction Z) to be machined, into each receiving part 18. The printed product 22 is received between the rest element 16 of said receiving part and its clamping member 20, which is located in the open position 20'. The printed product 22 comes into abutment in a sheet-like manner against the rest element 16 and, on its edge 26' opposite the edge 26 to be processed, against the base 28 of the receiving part 18. For this purpose, the feed location 24 is preferably arranged in the region of the deflection around the deflection wheel where the rest elements 16 assume an inclined position with respect to the horizontal shown on the left-hand side in FIG. 1.

As seen in the direction of circulation U, an aligning station 30 is provided downstream of the feed location 24, in the region of the rectilinear part of the circulating path 18'. The aligning station is disposed beneath the upper strand 10' of the drawing member 10. The aligning station includes an endless drawing element 32 which is specified in a chain-dotted line and is driven in the same direction as the direction of circulation U and at the same speed as the drawing member 10. Arranged likewise at a distance A one behind the other on the drawing element 32 are aligning cams 34. While the aligning cams 34 run through the upper strand of the drawing element 32, they can be moved, by a slotted-guide path 36, through openings in the base 28 into the receiving parts 18 in order to raise the printed products 22 to the desired level for alignment purposes. Above the circulating path 18', the aligning station 30 includes a vibration element 38 which acts on the edges 26, of the printed products 22, to be machined. The vibrations from the vibration element 38 causes the individual parts of the printed products 22 to butt against the aligning cam 34. As is specified by the double arrow 38', the vibration element 38 can be arranged such that it can be moved in and counter to the direction of circulation U, in order to run along with the printed products 22 in a section of the circulating path 18. Before the aligning cams 34 are lowered again, the clamping member 20 is moved into the clamping position 20". In a region running along the outer border of the rest element 16, the clamping member 20 in the clamping position 20" presses the printed product 22 against the rest element 16. As illustrated in FIG. 1, a region of the printed products 22 which adjoins the edge 26 to be machined projects beyond the rest element 16.

A milling station 40 is provided downstream of the aligning station 30. The milling station 40 mills the printed products, in the region of the edge 26 to be machined, back to the level 40' specified in a chain-dotted line (see also FIGS. 2–5).

As seen in the direction of circulation U, the milling station 40 is followed by a precision-machining station 42. The precision machining station 42 is followed by an adhesive-applying station 44 which applies adhesive onto the previously precision-machined spines 22' of the printed products 22.

In an adhesive-spine feeding station 46, a folded cover 48 is positioned in a straddling manner onto each printed product 22. At a downstream pressing-on station 50, the cover 48 is pressed by pressing-on elements 52, along the entire spine, onto the printed product 22. The pressing-on elements 52 are fastened on another endless, drawing element 54 (shown as a chain-dotted line). In this arrangement the pressing-on elements 52 circulate in the direction of the arrow 52' and, in a section of the circulating path 18' run along with the printed products 22 and press on the covers 48.

56 specifies a drying station which is located in the region of the deflection of the receiving parts. 18 around the deflection wheel 14 (shown on the right-hand side in FIG. 1). In the drying station 56, the adhesive is dried, for example by means of heat, ultrasound or a draft of air.

As the products 22 are transported along the lower strand of the circulating path 18', the adhesive dries off and the printed products 22, which may have been heated in order to accelerate the drying operation, cool off. Arranged beneath the feed location 24 is a discharge region 58. In the discharge region 58, the clamping members 20 are moved into the open position 20' in order to release the bound finished products 60. The finished products 60 slide out of the receiving parts 18 onto a removal belt 62, which circulates in the removal direction W. Here the products are transported away in imbricated formation.

The arrow 64 specifies an insertion station for inserting, for example, a card from above between each cover 48 and the printed product 22 arranged therein. This can be done without difficulty since, the covers 48 are still partially open upon running through the lower strand since the rest element 16 and the clamping members 20 engage between the covers and the printed products 22.

As is illustrated by the chain-dotted rectangle 66, it is also conceivable for some or all of the machining stations, 30, 40, 42, 44, 46, 50, 56 to be arranged beneath the upper section of the circulating path 18' of the receiving parts 18. In this case, the printed products 22 are introduced, at the feed location 24, into the receiving parts 18, which do not necessarily include a base 28. The printed products are introduced with the edge 26, to be machined, in front, and are aligned. The printed products are machined in the region which runs along the edge 26 and which projects downwardly beyond the rest elements 16. In this case, the clamping members 20 act correspondingly in the lower end region of the receiving parts 18. The printed products 22 are prevented from falling downwards by supporting means between the feed location 24 and the aligning station.

If necessary, the finished products 60 can be further cut to size in a cutting station 68, as is known, for example, from CH-A-668 216.

Figure 2:
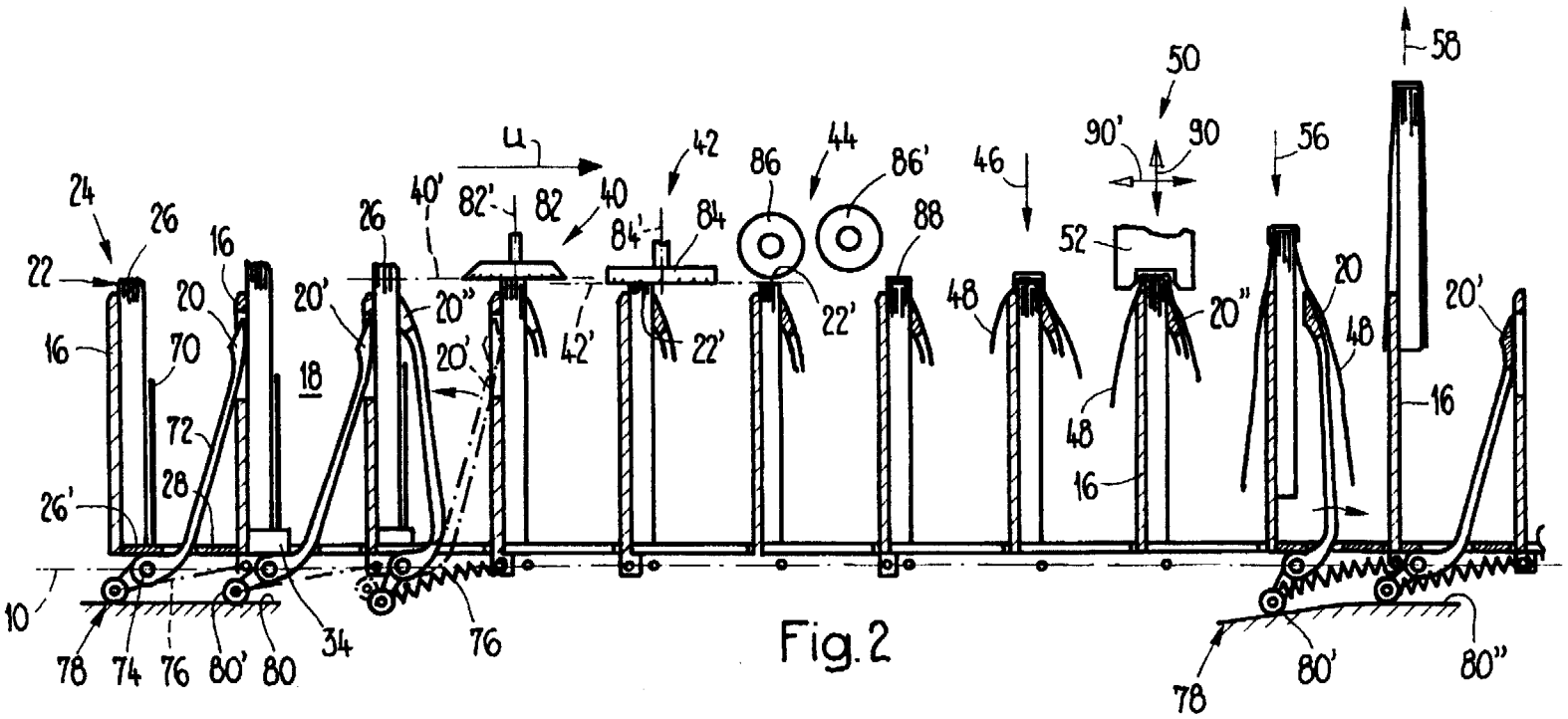
FIG. 2 shows, in a telescoped representation, the machining steps in various machining stations.

FIG. 2 shows, in a telescoped form, the machining of the printed products 22 which have been introduced into the receiving parts 18. The bases 28 of the receiving parts 18 are fastened on the drawing member 10. The rest elements 16 project in the form of an L from the bases at the rear end, as seen in the direction of circulation U. Further, a wall element 70 may project into each receiving part 18 from the base. Such a wall element runs parallel to the rest element 16 and is spaced apart from the latter by more than the thickness of the printed products 22 to be machined. Thus, the printed products can be introduced, at the feed location 24, between the rest element 16 and the wall element 70. On the side which is directed away from the interior of the receiving part 18, a two-armed lever 72 is mounted on each base 28 around a pivot pin 74. The pivot pin 74 runs perpendicular to the drawing member 10. One lever arm engages through a through-passage of the base 28 and projects into the interior of the receiving part 18. The clamping member 20 is arranged at the free end of this one lever arm. At the free end of the other lever arm there is fastened a closure spring 76 which is designed as a tension spring and, at the other end, is articulated on the base 28 of the preceding receiving part 18 (as seen in the direction of circulation U). The closure spring 76 prestresses the clamping member 20 in the direction of the clamping position 20". Counter to the action of said closure spring 76, the clamping member 20, by means of a slotted-guide control 78, is transferred into and/or held in the open position 20'. In this open position 20' the free end of the clamping member 20 engages into a cutout of the preceding rest element 16 and is covered over by the rest element. This ensures problem-free introduction of the printed products 22 into the receiving parts 18. The slotted-guide control 78 includes a follow-on roller 80' which is mounted rotatably on the lever 72 and interacts with an opening slotted-guide path 80. These hold the clamping member 20 in the open position 20' at the feed location 24 and during the alignment of the printed products 22 by the aligning cams 34. After the alignment, the follow-on roller 80' runs off the opening slotted-guide path 80. As a result, the clamping member 20 pivots into the clamping position 20".

The milling station 40 includes an end cutter 82. The end cutter 82 is driven in rotation around its axis 82' and arranged perpendicular to the circulation direction U. The end surface of the end cutter 82 is set to the level 40'. It will be recognized that a plurality of end cutters 82 may be arranged such that they are offset transversely with respect to the circulation direction U.

84 designates an end grinding wheel 84, of the precision-machining station 42. The grinding wheel 84 is driven in rotation about its axis 84' which is parallel to the axis 82'. The end surface of the grinding wheel 84 is set to the level 42' in order to grind the spine 22', produced in the milling station 40, down to this level 42'. Of course, here too, a plurality of end grinding wheels 84 may be arranged such that they are offset in the direction transverse with respect to the direction of circulation U.

The adhesive-applying station 44 includes first and a second adhesive-applying rollers 86 and 86', respectively. The adhesive-applying rollers 86, 86' are arranged such that they are offset both in the circulation direction U and with respect to their height, in order to apply two layers of adhesive onto the spine 22' one after the other. For this purpose, the adhesive-applying rollers 86, 86' are mounted such that they can rotate around axes which run perpendicular to the circulation direction U and parallel to the spines 22'. The adhesive application is designated by 88.

In FIG. 2, the adhesive-spine feeding station 46 is specified only by an arrow. It may be a generally known feeder with an opening device. It is, however, contemplated that the folded covers 48 may be fed opened and deposited in a straddling manner onto the spines provided with the adhesive application 88 using a gripper conveyor.

The pressing-on station 50 includes pressing on elements 52, only one of which is illustrated schematically. In contrast to the circulating arrangement, as shown in FIG. 1, it is also contemplated that the pressing-on element 52 may be raised and lowered, as is represented by the double arrow 90, and moved back and forth in the direction of circulation U and counter thereto, as is represented by the double arrow 90'. A pressing-on element 52 is thus lowered onto the cover 48 and, co-runs in the direction of circulation U, to press the cover 48 onto the printed product 22. Subsequently, the pressing-on element is raised and moved back counter to the circulation direction U in order to press on the next cover 48.

The drying station is represented by the arrow 56. In the discharge region 58, the clamping members 20 are pivoted out of the clamping position 20" into the open position 20' due to the follow-on rollers 80' running onto another opening slotted-guide path 80". In this arrangement, the clamping member 20 is controlled such that it is not possible for a cover 48 to be clamped in between it and the preceding rest element 16.

Figure 3:
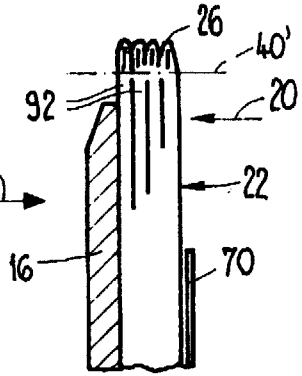
FIG. 3 shows the milling of printed products which are arranged in receiving parts which are open in the direction towards the top.

FIG. 3 shows a printed product 22 (on an enlarged scale relative to FIG. 2) which is arranged in a receiving part 18 and is held such that it is clamped in between the rest element 16 and the clamping member 20. The receiving part 18 is open in the direction towards the top. A region of the printed product 22 which adjoins the edge 26 to be machined projects beyond the rest element 16. 40' designates the level at which the machining in the milling station 40 takes place.

Figure 4:
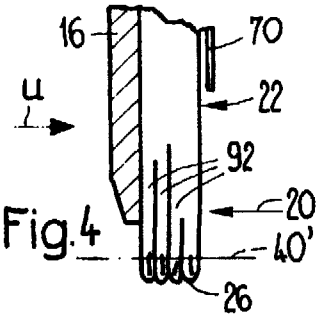
FIG. 4 shows, in the same representation as FIG. 3 the milling of printed products which are arranged in downwardly open receiving parts.

FIG. 4 shows, in the same representation, a receiving part 18 which is open towards the bottom and beyond whose rest element the printed product 22 projects. The level 40' is here arranged above the edge 26. The printed products 22 may also be machined in this position of the receiving parts 18 (see FIG. 1 and the machining stations indicated by the rectangle 66).

The printed products shown in FIGS. 3 and 4 include a plurality of multiple-leaf, folded product parts 92 which butt against one another in a sheet-like manner. It is, however, also contemplated that a printed product 22 may comprise a stack of sheets or a plurality of folded sheets inserted one into the other.

Figure 5:
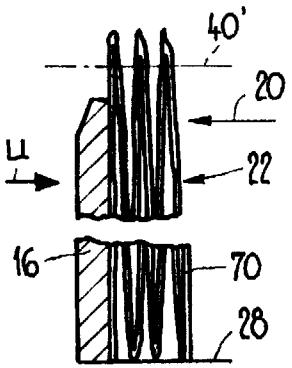
FIG. 5 shows the milling of a printed product which is folded in zigzag form and is arranged in an upwardly open/receiving part.

As can be seen in FIG. 5, it is also contemplated that a printed product 22 may comprise a plurality of product parts which are folded together in zigzag form. Printed products 22 which are thus folded in zigzag form may be formed, for example, apparatuses such as those which are disclosed in U.S. Pat. Nos. 4,408,755 and 4,408,754 and corresponding CH Patent Specification Nos. 645074 and 645073.

Figure 7:
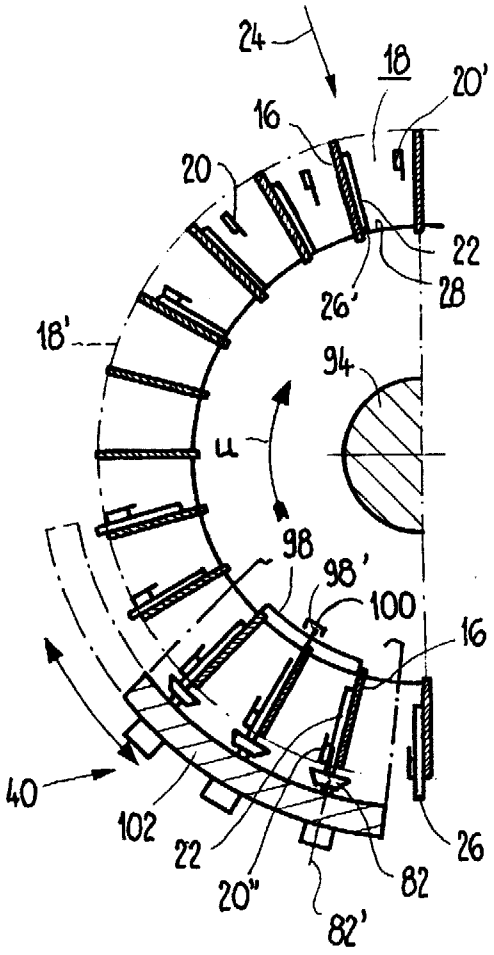
FIG. 7 shows a vertical section, along line VII—VII in FIG. 6, through one half of the apparatus shown there.
Figure 6:
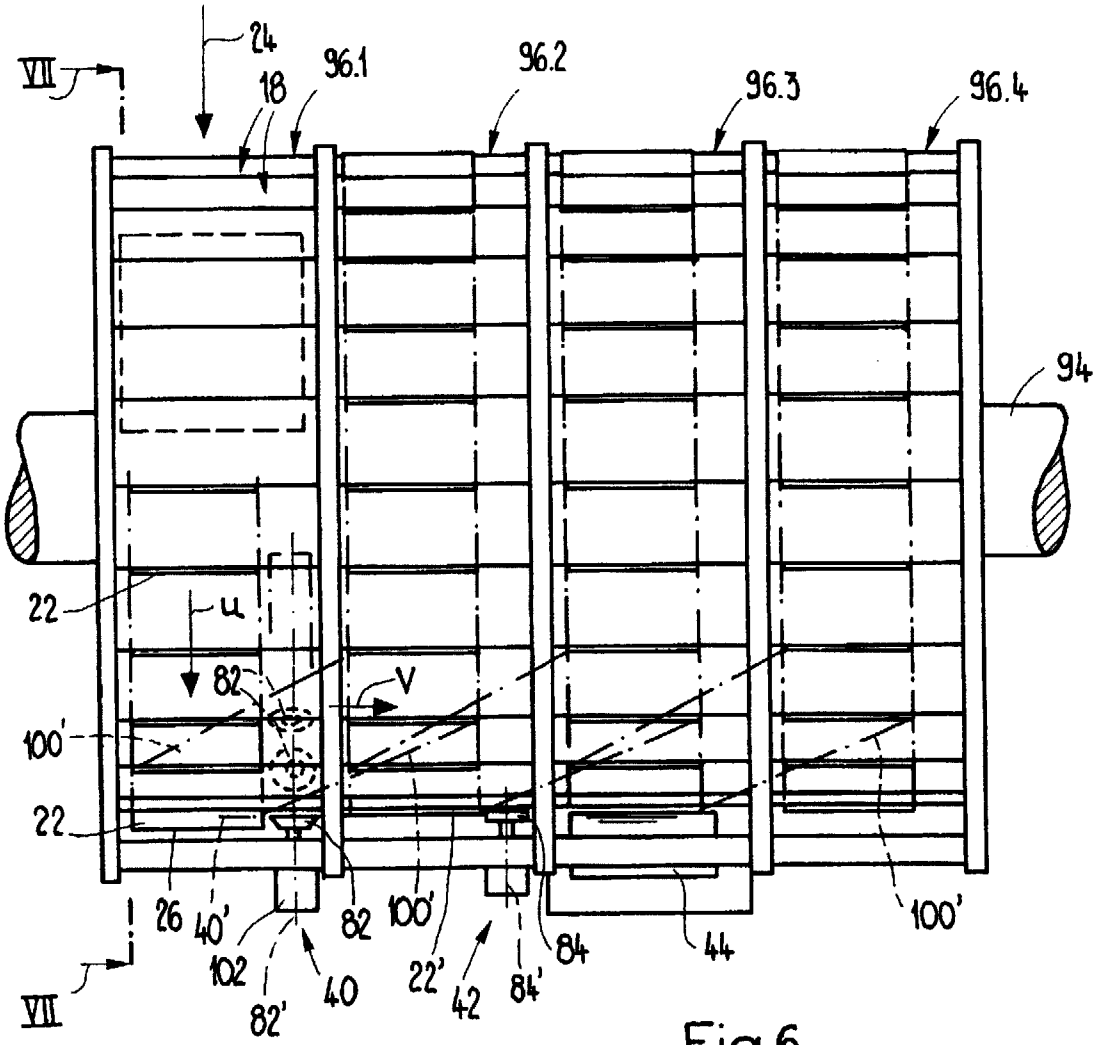
FIG. 6 shows, in elevation, a second embodiment of the adhesive-binding apparatus according to the invention, having receiving parts which are arranged in the manner of a drum around a common rotational spindle, are driven continuously in rotation and in which the printed products are displaced in the axial direction and machinings take place during this axial displacement.

In the embodiment of the invention which is shown in FIGS. 6 and 7, the receiving parts 18 are distributed, in the circumferential direction, in the manner of a drum around a common horizontal rotational shaft 94. The sheet-like rest elements 16 n parallel to the rotational shaft 94 and approximately radially relative to the shaft 94 and extend in the longitudinal direction of the rotational shaft 94 over a plurality of sections 96.1, 96.2, 96.3, 96.4. The rest. elements 16, together with the respective clamping members 20, are mounted such that they can be moved in the longitudinal direction of the rotational shaft 94. In each case three successive rest elements 16 (as seen in the direction of circulation U) are fixedly connected to one another via a slave bow 98. A follow-on member 98' is arranged on the sleeve bow 98 and is guided in a continuous displacement slottedguide path 100 which is fixed and runs around the rotational shaft 94. The clamping members 20, which are likewise prestressed in the clamping position 20", are mounted pivotably on the corresponding rest elements 16 and/or bases 28 projecting therefrom as is shown in FIG. 2. The clamping members 20 assigned to the interconnected rest elements 16 are connected to a common follow-on roller (not shown in FIGS. 6 and 7) which corresponds to the follow-on roller 80' and interacts with a slotted-guide path, analogous to the opening slotted-guide path 80, 80". This follow-on roller runs through an upper part of the circulating path 18', to pivot the clamping members 20 into the open position 20'. Suitable arrangements for the drive for the rest elements 16 as well as control means for the clamping members 20 are disclosed in U.S. Pat. Nos. 4,981,291 and 5,052,666 and corresponding EP-A-0341423 and EP-A-0341424.

The displacement slotted-guide path 100 is designed such that the receiving parts 18, as seen in the direction of circulation U, after running through the lowermost point of their circulating path 18', are advanced by one work stroke in the direction of the arrow V, during the time in which the drum rotates further by two receiving parts 18. The printed products 22 are thus moved from the drum sections 96.1, 96.2 and 96.3 into the following drum sections 96.2, 96.3 and 96.4. In the upper region of the circulating path 18' the clamping members 20 are no longer located in the clamping position 20". In this upper region, the rest elements 16 are moved back into the original position, counter to the direction of advancement V, without carrying along the printed products 22. The path which the printed products 22 cover during one work stroke is specified in FIG. 6 by chain-dotted lines 100'.

The feed location 24 is assigned to the first drum section 96.1. A printed product 22 to be machined is introduced into each radially outwardly open receiving part 18 which passes the feed location 24. The aligning station 30 and the milling station 40 are also assigned to the same drum section 96.1. The station 30 may be designed analogously to that of FIG. 1.

Three end cutters 82 are driven in rotation around their radially running axes 82'. These end cutters 82 are arranged (as seen in the direction of circulation U) at the same interval as the rest elements 16 and radially outside the circulating path 18', on a carrying bow 102 which can be pivoted back and forth around the rotational shaft 94. The end cutters 82 move along in the circumferential direction U with the respective three rest elements 16, which are coupled on one another, during the work stroke V thereof in order to mill the printed products 22. In this arrangement the,printed products 22 are transported along the chain-dotted lines 100', along the level 40' of the radially outer edge 26 to be machined. Since the work stroke V takes place during two work cycles, but three printed products 22 are machined at the same time, the carrying bow 302 still has one work cycle for moving back into the initial position counter to the direction of circulation U. The milling station 40 is then ready for machining the following printed products 22.

In the same manner as in the case of the milling station 40, three end grinding wheels 84 are arranged on the carrying bow 102, of the precision-machining station 42 assigned to the second drum section 96.2, in order to machine three printed products 22 during the work stroke.

It is also contemplated that the milling station 40 and precision-machining station 42 may be arranged at a location where the printed products 22 are at a standstill in the direction of the rotational shaft 94. In this case, the tools 82, 84 of these stations are moved.

The adhesive-applying station 44 is assigned to the third drum section 96.3, and the adhesive-spine feeding station, the pressing-on station, the drying station and the discharge region are assigned to the fourth drum section 96.4.

The printed products 22 which were introduced into the receiving parts 18 at the feed location 24 are aligned in the aligning station 30. Then, as the printed products 22 are being held such that they are clamped in between the rest elements 16 and clamping members 20, they are transported through the lower part of the circulating path 18'. Upon running through the milling station 40, they are machined along the edge 26 during the work stroke in the advancement direction V. The printed products 22 are then conveyed further in the circulation direction U in the second drum section 96.2. Here, the products may be aligned again by an aligning station with the clamping members 20 located in the open position 20'. During the advancement V from the second drum section 96.2 to the third drum section 96.3, the printed products 22 are precision-machined upon running past the precision-machining station 42. The remaining machining takes place in a corresponding manner in the drum sections 96.3 and 96.4, with the result that the finished products can be removed from the drum sections at the discharge region.

Figure 8:
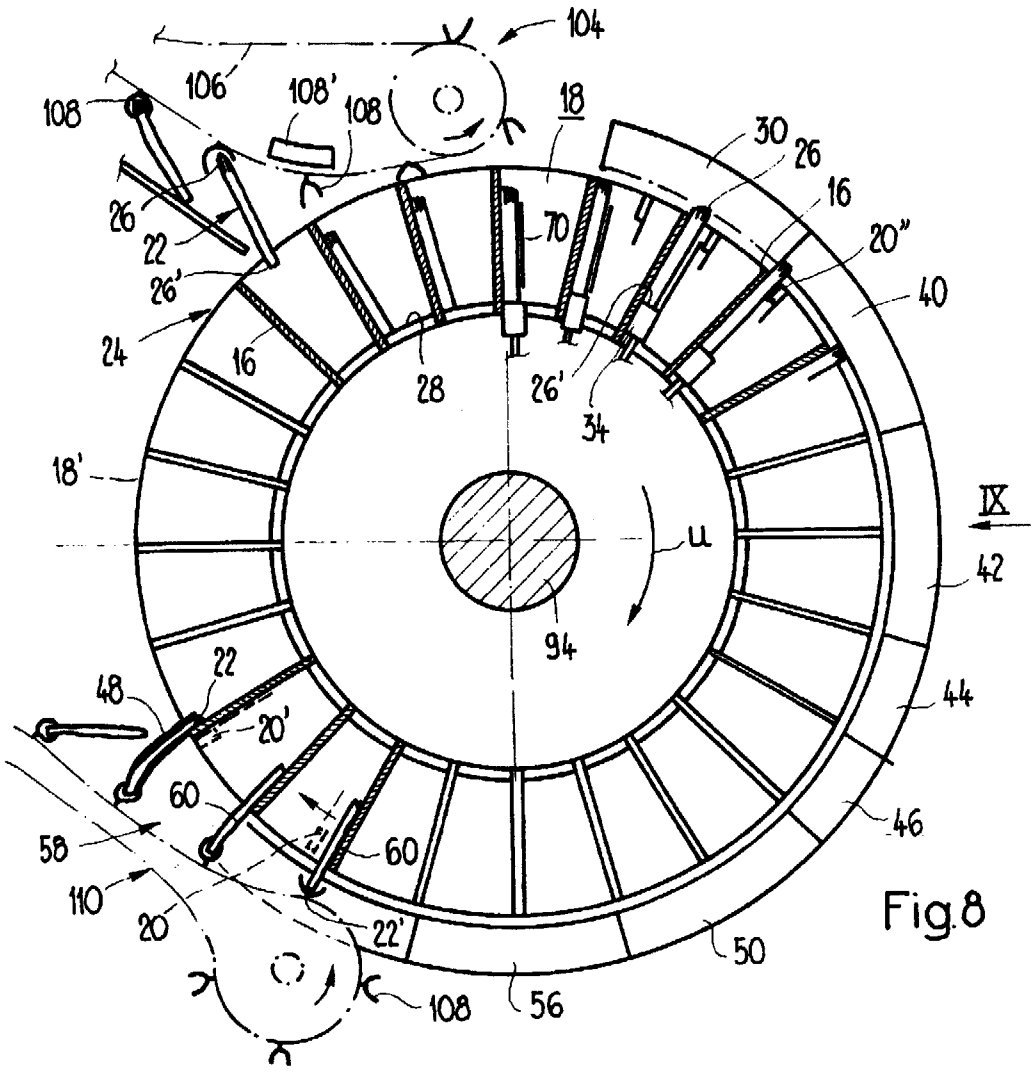
FIG. 8 shows, in a side view and partially in section, a further embodiment of the apparatus according to the invention, having receiving parts, which are arranged around a common rotational spindle, and machining stations which are radially on the inside and radially on the outside with respect to said receiving parts.
Figure 9:
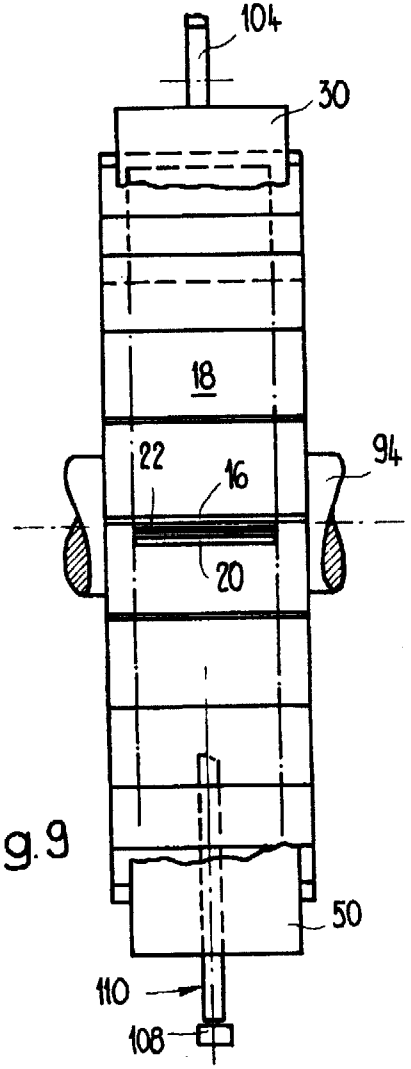
FIG. 9 shows, in elevation and partially in section, the apparatus shown in FIG. 8.

FIGS. 8 and 9 show a further embodiment of the apparatus according to the invention. In this embodiment, the receiving parts 18 are also distributed, in the circumferential direction, around a common rotational shaft 94 which runs in the horizontal direction. Here too, the sheet-like rest elements 16 run essentially radially relative to the rotational shaft 94 and parallel thereto. The machining of the printed products 22 takes place during the time which the receiving parts 18 circulate approximately three-quarters of the way around the rotational shaft 94. The receiving parts 18 are open radially outward. The various machining stations are arranged, one behind the other in the circulation direction U, between the feed location 24 and the discharge region 58, in the radial direction outside the circulating path 18' of the receiving parts 18. Leading to the feed location 24 is a generally known gripper conveyor 104. The gripper conveyor 104 includes individually controllable grippers 108 which are arranged one behind the other on a circulating chain 106 which is driven counter to the circulation direction U. Each of the grippers holds one printed product 22 at its edge 26 to be machined. The grippers place the printed products into the receiving parts 18 with the edge 26', opposite the edge 26, in front. By opening the grippers 108 with an opening control 108', the printed products 22 fall onto the base 28 of the receiving parts 8. This causes them to butt against the rest elements 16 in a sheet-like manner.

The aligning station 30 is provided. downstream of the feed location 24 (as seen in the direction of circulation U). In the aligning station 30, the printed products 22 are aligned by radially inner aligning cams 34, and if appropriate, radially outer vibration elements 38, as is shown in FIG. 1. A region of printed products 22 which adjoins the edge 26 which is to be machined projects radially outwards beyond the receiving parts 18. After the alignment of the printed products 22, the clamping members 20 are transferred into the clamping position 20" in order to clamp the printed products 22 fixedly between them and the rest elements 16. During further transportation in the circulation direction U, the printed products 22, as described above, are machined in the milling station 40, precision-machining station 42, adhesive-applying station 44, adhesive-spine feeding station 46, pressing-on station 50 and drying station 56. At the discharge region 58, which is arranged beneath the feed location 24, the clamping members 20 are gradually transferred into the open position 20'. As a result, the released finished products 60 slide out of the receiving parts 18, with their spine 22' in front, into opened grippers 108 of a removal conveyor 110. The removal conveyor may also be a gripper conveyor. After the grippers 108 are closed, the finished products 60 are conveyed away for further processing. In an embodiment where the removal conveyor 110 has a design corresponding to the grippers 108, a pressing-on station 50 and drying station 56 in the region of the circulation path of the receiving parts 18 may be dispensed with since the cover 48 can be pressed on by means of the grippers 108 and the adhesive can dry during transportation by the removal conveyor 110.

Figure 10:
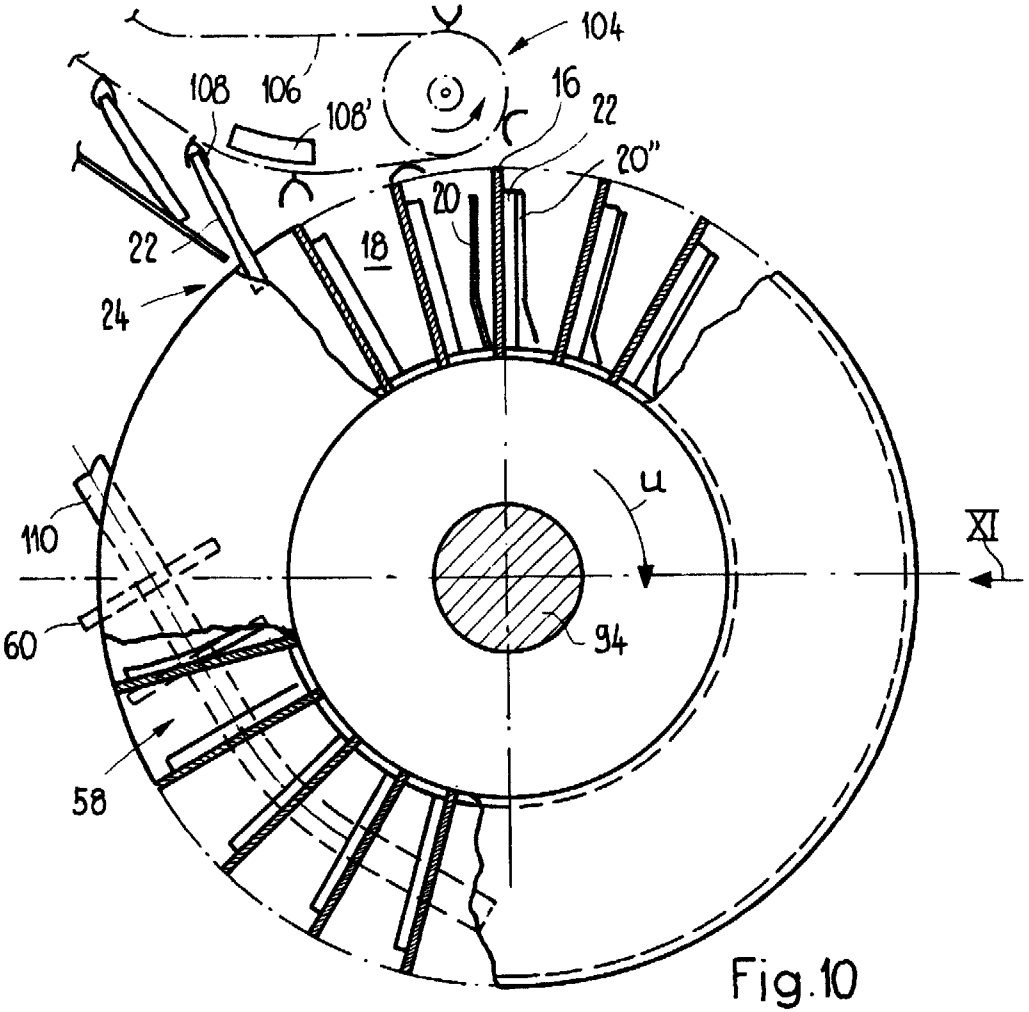
FIG. 10 shows, in a side view and partially in section, a further embodiment of the apparatus according to the invention, having receiving parts, which are arranged likewise around a common rotational spindle and are open on the end side, and machining stations which arranged on the end side.
Figure 11:
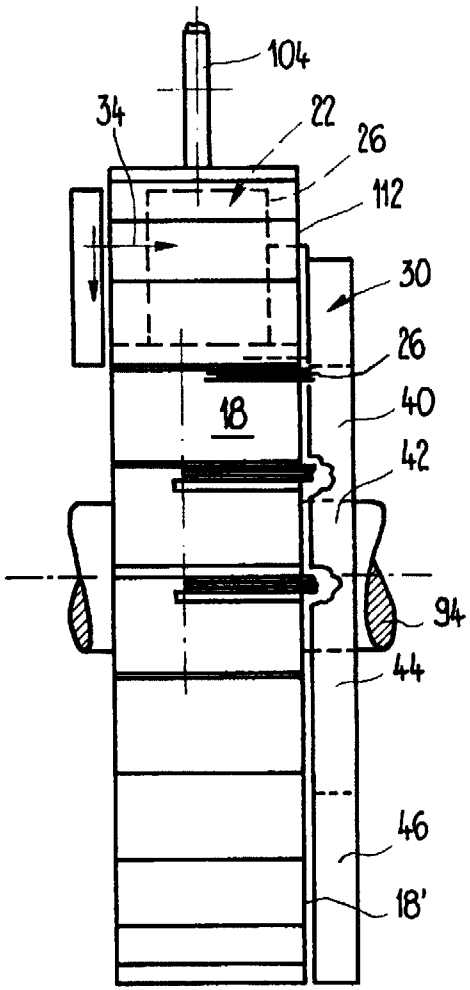

Another embodiment of the apparatus according to the invention is shown in FIGS. 10 and 1. This embodiment includes receiving parts 18 which are also distributed, in the circumferential direction, around a rotational shaft 94 which runs in the horizontal direction. Interacting with the sheet-like rest elements 16, of the receiving parts 18 (which are arranged in the radial direction and parallel to the rotational shaft 94) are clamping members 20. In this case the clamping members 20, interact with an end-side border region of the rest elements 16. The receiving parts 18 are open at least on this end side 112. The machining stations are arranged along the circulating path 18' of the open end side 112 of the receiving parts 18.

Leading to the feed location 24 is a gripper conveyor 104 which has been described above. The gripper conveyor 104 introduces the printed products 22 into the receiving parts 18, by means of its grippers 108. The printed products 22 are introduced (as seen in the feed direction) with a lateral edge 26 to be machined and an edge running transversely thereto in front. The aligning station 30 includes aligning cams which are represented by an arrow 34. The aligning cams engage into the receiving parts 18 from the side opposite the open end side 112 in order to align the printed products 22 with their edge 26 in front, such that a region which adjoins the edge 26 projects on the end side beyond the rest element 16. For this purpose, the aligning cams 34 are moved along with the receiving parts 18 over a section, as is specified by the arrow pointing in the direction of circulation U. After the alignment of the printed products 22, the clamping members 20 are transferred into the clamping position 20" in order to fixedly clamp the printed products 22 between them and the rest element 16.

During the further rotation in the arrow direction U, the printed products 22 are correspondingly machined on the end side in the milling station 40, precision-machining station 42, adhesive-applying station 44, adhesive-spine feeding station 46, etc., as is described above.

Arranged on the end side of the circulating path 18' of the receiving parts 18 is a removal conveyor 110 which is preferably also designed as a gripper conveyor. In the discharge region 58, each of the grippers in the gripper conveyor seizes one finished product 60, at the spine thereof, in order to transport it away.

Of course, it is not necessary for the apparatus for the adhesive binding of the printed products 22 to include all of the machining stations described. Depending on circumstances, machining stations may be left out or others may be arranged along the circulating path 18' of the receiving parts 18.

Instead of covers 48, gauzes or other types of adhesive-spine elements which engage over the spine 22' may also be used.

Of course, the feed location 24 may include a plurality of feed members which are arranged one behind the other and equip receiving parts 18, for example alternately, with printed products 22, with the result that, ultimately, a printed product 22 is present in each receiving part 18.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

a plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts.

2. The apparatus as in claim 1, wherein the machining stations comprise an adhesive applying station.

3. The apparatus as in claim 2, wherein the machining stations comprise a milling station.

4. The apparatus as in claim 3, wherein the machining stations comprise an adhesive-spine feeding station.

5. The apparatus as in claim 4, wherein the machining stations comprise a precision-machining station.

6. The apparatus as in claim 4, wherein the machining stations comprise an adhesive-spine pressing-on station.

7. The apparatus as in claim 6, wherein the machining stations comprise a drying station.

8. The apparatus as in claim 4, wherein the machining stations comprise an aligning station.

9. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

a plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts; and wherein the machining stations comprise an aligning station, having aligning members engaging into the receiving parts and running along therewith, and a control device which holds the clamping members in a position remote from the clamping position, upon running past the feed location and the discharge location, the aligning station aligning the printed products, and moving the clamping members into the clamping position after the alignment.

10. The apparatus as claimed in claim 1, wherein the machining stations comprise an adhesive-applying station, an adhesive-spine feeding station which is provided downstream of said adhesive-applying station, and a pressing-on station having pressing-on elements which run along with the printed products to press on the adhesive spines.

11. The apparatus as claimed in claim 1, wherein the receiving parts are arranged on an endless drawing member which is guided around spaced-apart deflection means rotating about an axis, the circulating path runs in an essentially rectilinear manner between the deflection means, and the processing stations with corunning tools arranged between the deflection means.

12. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

a plurality of machining stations which are arranged one behind the other and provided downstream of the feed station in the circulation direction, each of the machining stations including at east one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts; and wherein the receiving parts are arranged around a common, rotational axis, and have rest elements which run approximately in the radial direction and parallel to the rotational axis.

13. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts;

said receiving parts arranged on an endless drawing member which is guided around spaced-apart deflection means rotating about an axis, the circulating path runs in an essentially rectilinear manner between the deflection means, and the processing stations with co-running tools arranged between the deflection means; and wherein the machining stations are arranged inside the circulating path.

14. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping ember;

a plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts;

said receiving parts arranged on an endless drawing member which is guided around spaced-apart deflection means rotating about an axis, the circulating path runs in an essentially rectilinear manner between the deflection means, and the processing stations with co-running tools arranged between the deflection means; and wherein the machining stations are arranged outside the circulating path.

15. An apparatus for the adhesive binding of printed products comprising:

a plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

a plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, pun along with the printed products in the circulation direction and machine the printed products during the co-running operation;

a discharge station at which the finished products are discharged out of the receiving parts; and wherein the receiving parts are open on an end side, and the machining stations are arranged on the end side with respect to the circulation path.

16. The apparatus as claimed in claim 12, comprising a drive moving the rest elements and the clamping members in a displacement direction extending transverse to the circulation direction.

17. The apparatus as claimed in claim 16, wherein said machining tools are arranged stationary, as seen in the displacement direction for machining the printed products during transportation in the displacement direction.

18. An apparatus for the adhesive binding of printed products comprising:

a plurality of receiving parts arranged one behind the other and continuously driven in a circulation direction along a continuous circulating path;

each of said receiving parts having a rest element arranged transversely with respect to said continuous circulating path;

a feed station at which printed products are introduced into the receiving parts;

a plurality of machining stations which are arranged one behind the other and provided downstream of the feed station in the circulation direction, the plurality of machining stations including at least an adhesive applying station and an adhesive-spine feeding station provided downstream of the adhesive applying station, each of the machining stations including at least one machining tool which acts on each printed product which is transported past the respective machining station, and wherein the tools, in at least certain sections along the circulating path, run along with the printed products in the direction of circulation and machine the printed products during the co-running operation;

a discharge station at which bound finished products are discharged out of the receiving parts.

19. The apparatus as in claim 18 further comprising a milling station.

20. The apparatus as in claim 18 further comprising a pressing-on station.

21. An apparatus for the adhesive binding of printed products comprising:

plurality of receiving parts arranged one behind the other and continuously driven in a circulation direction along a continuous circulating path, each of the receiving parts having a rest element arranged transversely with respect to said continuous circulating path and a controllable clamping member which interacts with the rest element;

a feed station at which printed products are introduced into the receiving parts, between the rest element and the clamping member;

plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a discharge station at which the finished products are discharged out of the receiving parts; and a drive for moving the rest elements and the clamping members in a displacement direction extending transverse to the circulation direction.

22. The apparatus as claimed in claim 21, wherein said machining tools are arranged stationary, as seen in the displacement direction for machining the printed products during transportation in the displacement direction.

23. An apparatus for the adhesive binding of printed products comprising:

a plurality of receiving parts arranged one behind the other and continuously driven in a circulation direction along a continuous circulating path, each of the receiving parts having a rest element and a controllable clamping member which interacts with the rest element;

a feed station at which printed products are introduced into the receiving parts, between the rest element and the clamping member;

a plurality of machining stations which are arranged one behind the other and provided downstream of the feed station in the circulation direction, each of the machining stations including at least one machining tool which acts on each printed product which is transported past the respective machining station, and wherein the tools, in at least certain sections along the circulating path, run along with the printed products in the circulation direction and machine the printed products during the co-running operation;

a plurality of aligning cams arranged one behind the other along said continuous circulating path and movable into said receiving parts in a direction such that they engage and displace the printed products toward a machining station;

a discharge station at which the finished products are discharged out of the receiving parts.

24. The apparatus as in claim 23, wherein the machining stations comprise an adhesive applying station.

25. The apparatus as in claim 24, wherein the machining stations comprise a milling station.

26. The apparatus as in claim 25, wherein the machining stations comprise an adhesive-spine feeding station.

27. The apparatus as in claim 26, wherein the machining stations comprise a precision-machining station.

28. The apparatus as in claim 26, wherein the machining stations comprise an adhesive-spine pressing-on station.

29. The apparatus as in claim 28, wherein the machining stations comprise a drying station.

30. The apparatus as in claim 26, wherein the machining stations comprise an aligning station.

31. The apparatus as claimed in claim 23, wherein the machining stations comprise an aligning station having aligning members engaging into the receiving parts and running along therewith, and a control device which holds the clamping members in a position remote from the clamping position, upon running past the feed location and the discharge location, the aligning station aligning the printed products, and moving the clamping members into the clamping position after the alignment.

32. The apparatus as claimed in claim 23, wherein the machining stations comprise an adhesive-applying station, an adhesive-spine feeding station which is provided downstream of said adhesive-applying station, and a pressing-on station having pressing-on elements which run along with the printed products to press on the adhesive spines.

33. The apparatus as claimed in claim 23, wherein the receiving parts are arranged on an endless drawing member which is guided around spaced-apart deflection means rotating about an axis, the circulating path runs in an essentially rectilinear manner between the deflection means, and the processing stations with corunning tools arranged between the deflection means.

34. The apparatus as claimed in claim 23, wherein the receiving parts are arranged around a common, rotational axis, and have rest elements which run approximately in the radial direction and parallel to the rotational axis.

35. The apparatus as claimed in claim 33, wherein the machining stations are arranged inside the circulating path.

36. The apparatus as claimed in claim 33, wherein the machining stations are arranged outside the circulating path.

37. The apparatus as claimed in claim 23, wherein the receiving parts are open on an end side, and the machining stations are arranged on the end side with respect to the circulation path.

38. The apparatus as claimed in claim 34, comprising a drive moving the rest elements and the clamping members in a displacement direction running transversely with respect to the circulation direction.

39. The apparatus as claimed in claim 38, wherein said machining tools are arranged stationary, as seen in the displacement direction for machining the printed products during transportation in the displacement direction.

* * * * *

UNITED STATES PATENT AND TRADEMARK OFFICE

CERTIFICATE OF CORRECTION

PATENT NO. : 5,667,211

DATED : September 16, 1997

INVENTOR(S) : Walter Reist

It is certified that error appears in the above-indentified patent and that said Letters Patent is hereby corrected as shown below:

On the Title Page

In column 2, line 4, under "FOREIGN PATENT DOCUMENTS" replace "21144510" with --2114510--.

In the Claims

In claim 11, line 6, change "corunning" to --co-running--.

In claim 13, line 13, before "plurality" insert --a--.

In claim 14, line 12, change "ember" to --member--.

In claim 15, line 20, change "pun" to --run--.

In claim 21, line 3, before "plurality" insert --a--.

In claim 21, line 13, before "plurality" insert --a--.

UNITED STATES PATENT AND TRADEMARK OFFICE

CERTIFICATE OF CORRECTION

PATENT NO. : 5,667,211

DATED : September 16, 1997

INVENTOR(S) : Walter Reist

It is certified that error appears in the above-indentified patent and that said Letters Patent is hereby corrected as shown below:

In the Claims (cont'd)

Col. 15, In claim 33, line 6, change "corunning" to --co-running--.

Signed and Sealed this

Eleventh Day of April, 2000

*Attest:*

*Attesting Officer*

Q. TODD DICKINSON

*Director of Patents and Trademarks*